US006558865B2

(12) United States Patent
Endo et al.

(10) Patent No.: US 6,558,865 B2
(45) Date of Patent: May 6, 2003

(54) TONER COMPOSITION

(75) Inventors: Akira Endo, Midori-ku (JP); Mitsuru Ohta, Kani (JP); Hideo Ohira, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/956,025

(22) Filed: Sep. 20, 2001

(65) Prior Publication Data

US 2002/0064722 A1 May 30, 2002

(30) Foreign Application Priority Data

Sep. 29, 2000 (JP) ..... 2000-299307

(51) Int. Cl.[7] ..... G03G 9/08
(52) U.S. Cl. ..... 430/108.6; 430/108.7
(58) Field of Search ..... 430/109.1, 109.3, 430/111.4, 108.6, 108.7

(56) References Cited

U.S. PATENT DOCUMENTS 6,054,239 A * 4/2000 Ohira et al. ..... 430/106
6,255,029 B1 * 7/2001 Hirose et al. ..... 430/137

FOREIGN PATENT DOCUMENTS

| | | |
|---|---|---|
| JP | 10-326029 | 12/1998 |
| JP | 11-65164 | 3/1999 |

* cited by examiner

*Primary Examiner*—John Goodrow
(74) *Attorney, Agent, or Firm*—Oliff & Berridge, PLC

(57) ABSTRACT

A toner composition that permits printing of clear-cut and high image quality without developing a fog or a blur is provided. Binder resin particles manufactured through a dispersing polymerization method are colored using a dye and are then subjected to a process of injecting an organic finely divided powder and a charge controlling agent and to a process of externally adding a hydrophobic silica and a conductive titanium oxide, thereby making a toner composition having an average particle diameter by volume of 7 μm or less, a coagulation level of 10% or less, and an external additive coating ratio of 70% or less

9 Claims, 5 Drawing Sheets

MANUFACTURING PROCESSES OF DISPERSED AND POLYMERIZED TONER COMPOSITION

- DISPERSING AGENT
- SOLVENT
- MONOMER
- INITIATOR
- CROSSLINKING AGENT

TONER COMPOSITION

BACKGROUND OF THE INVENTION

1. Field of the Invention

The present invention relates to a toner composition used, for example, as dry toner for developing an electrostatic latent image.

2. Description of Related Art

A toner using a binder resin as the major component and containing a pigment, a charge controlling agent, an external additive or the like has conventionally been used as a toner for a printer employing an electrostatic latent image developing system.

For example, in a printer employing an electrostatic latent image developing system as shown in FIG. 5, this type of toner T may be fed off from a tank 1 by a supply roller 2. After a toner layer formed on a developing roller 3 is made uniform by a blade 7, the toner T is applied to the surface of a photoconductor 4.

The surface of the photoconductor 4 is charged so as to correspond to a certain image pattern by a laser scanner unit 5 and a corona unit 6, while the toner T is charged to a polarity opposite to that on the surface of the photoconductor 4. The toner T is therefore attracted onto a portion charged on the photoconductor 4, but not to portions which are not charged. Namely, the toner T is dispersed so as to correspond to the certain image pattern (charge pattern) on the surface of the photoconductor 4.

A medium 9 such as paper or the like is then pressed against the photoconductor 4 via an image transfer roller 8 so that the toner image may be transferred onto the medium 9. Heat is then applied to the toner T by a fusing roller 10 so that it is melted and fused on the surface of the medium, thus accomplishing printing of the image.

To ensure printing of high image quality using the aforementioned method, it is necessary to prevent a fog (a symptom noted on the surface of a photoconductor and a recording medium in which toner sticks to a location to which it should not stick) and a blur (a symptom noted on a printed medium in which breaks of toner occur).

To prevent a fog, toner must be sufficiently charged so that an attraction force (a Coulomb force) acting between the toner and a charged portion on a surface of the photoconductor (to which toner is supposed to stick) becomes strong.

It is also necessary to make the level of charge of toner uniform, thereby minimizing a ratio of part of toner that is not sufficiently charged or that is charged to an opposite polarity.

It has therefore been conventionally practiced that a charge controlling agent and an external additive are added to the toner to increase the level of charge of toner and that a conductive titanium oxide is used as the external additive to make the level of charge of toner uniform.

To prevent a blur, on the other hand, an adequate amount of toner must be supplied smoothly to different components of the printer (e.g., the supply roller, the developing roller, and the photoconductor).

To accomplish it, it is necessary to increase fluidity of toner so as not to allow toner particles to be coagulated easily. To do that, it has been conventionally practiced that a hydrophobic silica is externally added to the toner.

Increasing the level of charge of toner by adding a charge controlling agent or an external additive and making the level of charge uniform by adding a conductive titanium oxide have not been sufficient to ensure high print image quality.

That is, even with these measures taken, there are left toner particles that are not sufficiently charged or toner particles that are charged to an opposite polarity (faultily charged toner particles) among the toner particles charged. The faultily charged toner particles are attracted by a Coulomb force and accumulated onto the surface of the developing roller. From the surface of the developing roller, the faultily charged toner particles are transferred to the surface of the photoconductor, thus sticking to a portion on the surface of the photoconductor, to which they are not supposed to stick, resulting at times in a fog.

Especially when running a continuous durability print cycle to print large numbers of pages, the level of charge of toner as a whole gradually drops to increase the number of faultily charged toner particles as the printer turns out more printed pages. This significantly increases the amount of faultily charged toner particles piled up on the surface of the developing roller, thus aggravating the fog problem.

Another problem that has conventionally been common is that a hydrophobic silica or other substance that is externally added to enhance fluidity of toner is separated from the toner and sticks to the photoconductor and a recording medium and the external additive prevents toner from sticking to the photoconductor and the recording medium, resulting in a blur on the printed image.

SUMMARY OF THE INVENTION

In view of the foregoing, it is therefore an object of the invention to provide a toner composition that ensures printing of clear-cut images of high quality without producing a fog or a blur.

To achieve the foregoing object, a toner composition according to one aspect of the invention has a shape of a particle containing a binder resin, and a surface of the toner composition is coated with an external additive comprising a hydrophobic silica and a conductive titanium oxide and, at the same time, the particle making up the toner composition has an average particle diameter by volume of 7 $\mu$m or less and an external additive coating ratio of 70% or less and a coagulation level indicating the degree with which each of toner particles making up the toner composition is coagulated each other is 10% or less.

<1> Effect of Preventing a Fog i) A particle making up the toner composition according to the invention (hereinafter referred to as the toner particle) has a small average particle diameter by volume of 7 $\mu$m or less, which results in a high ratio of a surface area of the toner particle to a weight thereof. This makes it possible to inject a larger amount of the charge controlling agent to the surface of the toner particle with respect to the weight thereof, allowing the level of the charge per unit weight of the toner particle to be made high.

Since the surface of the toner composition according to the invention is covered with the conductive titanium oxide, a charge can be transferred by way of the conductive titanium oxide between toner particles, contributing to smaller variations in the level of charge among different toner particles.

In, for example, a printer that employs a system of charging toner particles by letting a blade and toner particles on a surface of a developing roller rub together as shown in FIG. 5, it is difficult to allow all toner particles to be in uniform contact with the blade, which tends to cause variations in the level of charge to become greater among different toner particles, which is particularly true when the toner particles become small. Thanks to the effect of the conductive titanium oxide, the toner composition according to the invention allows toner particles to be uniformly charged.

Namely, in the toner composition according to the invention, the average particle diameter by volume of the toner particle is made small and, at the same time, the surface of the toner composition is covered with the conductive titanium oxide. This allows the level of charge per unit weight of the toner composition to be higher and, at the same time, the distribution of the level of charge to be narrower.

When the toner composition according to the invention is charged, there are contained very little toner particles that are not sufficiently charged or toner particles that are charged to an opposite polarity, and there is no chance of faultily charged toner particles being accumulated on, for example, the developing roller. A fog is not, therefore, likely to result from the toner composition according to the intention.

Particularly when printing a large number of pages continuously (in a continuous durability print cycle), the charge controlling agent and the external additive made of hydrophobic silica may gradually separate from the toner particle or they may be embedded inside the toner particle, causing the level of charge of the toner particle being gradually decreased Even in such a case, the toner composition according to the invention has a high level of charge per unit weight and a narrow distribution of the level of charge in the beginning, it is less likely that faultily charged toner particles are produced and therefore there is less chance of faultily charged toner particles being accumulated on the developing roller.

ii) The toner composition according to the invention has a characteristic that, because of the conductive titanium oxide contained therein, a fluidity thereof does not drop even when it is subjected to a repetitive mechanical force by a roller of the printer or the like during, for example, a continuous durability print cycle.

Therefore, since an amount more than necessary of the toner composition according to the invention supported by the developing roller is easily scraped off by, for example, the photoconductor or the supply roller, there is no possibility that an amount of toner composition more than a predetermined one is accumulated on the developing roller, which contributes to an even smaller likelihood that a fog occurs.

iii) As described earlier, the toner composition according to the invention has a high level of charge per unit weight and a narrow distribution of the level of charge. This allows the toner particles to be distributed accurately on, for example, the surface of the photoconductor of the printer, corresponding to a charged pattern on the surface of the photoconductor, thus reducing the chance of producing a fogs That is, since the toner composition according to the invention has a high level of charge per unit weight, the attraction force (a Coulomb force) acting between the toner particle and a portion on the surface of the photoconductor that is charged (to which toner is supposed to stick) is sufficiently stronger than the attraction force (e.g., a van der Waals attraction) acting between the toner particle and a portion on the surface of the photoconductor that is not charged (to which toner should not stick). Toner particles are therefore selectively attracted onto the charged portion on the surface of the photoconductor. Moreover, since the distribution of the level of charge among different toner particles is narrow (that is, the ratio of faultily charged toner particles remains low), only a small amount of toner particles stick to the non-charged portion on the surface of the photoconductor.

It is preferable that the average particle diameter by volume of the toner composition range, for example, between 1 and 7 $\mu$m. Making the average particle diameter by volume of the toner composition to 1 $\mu$m or more, a toner spill inside the printer can be prevented, eliminating the possibility of spilled toner composition's contaminating a printed medium.

<2> Effect of Preventing a Blur i) Since the external additive coating ratio of the toner composition according to the invention is 70% or less, there is sufficient room on the surface of the toner particle for applying an external additive and a large part of the external additive is present being stuck to the surface of the toner particle and there is only a very little of the external additive present away and free therefrom.

In the toner composition according to the invention, therefore, there is no chance that the external additive away and free from the toner particle sticks to, for example, the surface of the photoconductor or a recording medium (e.g., paper, OHP transparencies), thereby impeding the toner composition from sticking to the surface of the photoconductor or the recording medium, which contributes to a less chance of a blur.

It is preferable that the external additive coating ratio range between, for example, 5 and 70%. By making the external additive coating ratio to a value of 5% or more, it becomes possible, for example, to stably replenish the supply of toner composition, allowing a uniform toner layer to be formed. This, in turn, results in a blur being prevented.

ii) Since the toner composition according to the invention contains a hydrophobic silica as the external additive, it offers a high fluidity and is not easy to coagulate (coagulation level of 10% or less).

Moreover, only an adequate amount of the toner composition according to the invention is supplied smoothly to, for example, different components of the printer (e.g., the supply roller, the developing roller, and the photoconductor), which helps prevent a blur from occurring.

It is preferable that the coagulation level of the toner composition range between 1 and 10%. By making the coagulation level to a value of 1% or more, fluidity of the toner composition does not become excessively high, which helps prevent, for example, a toner spill inside the printer. This eliminates the possibility of spilled toner composition's contaminating a printed medium.

<3> Effect from Being Capable of Printing to a High Resolution

Since the toner composition according to the invention has an average particle diameter by volume of 7 $\mu$m or less, it can be applied to printing requiring a high resolution The toner composition according to the invention may contain components, for example, a dye, pigment, organic finely divided powder, charge controlling agent or the like, in addition to the binder resin.

Typical types of hydrophobic silica include silica subjected to surface treatment using dimethyldichlorosilane, dimethyl polysiloxane, hexamethyldisilazine, amino-silane, and amine, or the like. Commercially available silica products include, for example, H2000, H3004, HVK2150, or the like manufactured by Wacker Co., Ltd. and R974, RY200, RX200, RX300, RA200H, REA200, or the like manufactured by Nippon Aerosil Co., Ltd.

As the conductive titanium oxide, it is preferable that titanium oxide having undergone surface treatment using tin oxide-based semiconductor or indium oxide-based semiconductor be used. It is particularly preferable that the conductive titanium oxide have a resistance value of about 1 to 50 Ω·cm and a BET area/weight ratio of about 5 to 70 $m^2/g$. Example commercially available products include EC-100, EC-210, EC-300, EC-500 or the like manufactured by Titan Kogyo Kabushiki Kaisha.

The external additive coating ratio refers to the ratio of a portion covered with the external additive to the entire surface area of the toner composition. The external additive coating ratio may be calculated, for example, using the following equation, where S ($m^2/g$) is a BET area/weight ratio of the external additive, R (μm) is an average particle diameter by quantity, ρ ($g/cm^3$) is a true specific gravity of the toner composition, and P (%) is the amount of external additive applied.

External additive coating ratio (%)=(S×R×ρ×P)/24

The coagulation level is an index indicating the degree with which each of toner particles making up the toner composition is coagulated each other and may be calculated, for example, as follows.

A coarse mesh (e.g., a mesh having a sieve opening of 75 μm), an intermediate mesh (e.g., a mesh having a sieve opening of 45 μm), and a fine mesh (e.g., a mesh having a sieve opening of 20 μm) are mounted in the upper step, middle step, and the lower step, respectively, of a powder tester (e.g., model PT-E powder tester manufactured by Hosokawa Micron Corporation) and a sample weighing W g (e.g., 10 g) is placed on the mesh in the upper step.

The test setup is then vibrated with a predetermined amplitude (e.g., an amplitude causing the amplitude scale to be 1 mm) for a predetermined period of time (e.g., 30 sec.). Then, weight Wa of the sample left on the upper step mesh, weight Wb of the sample left on the middle step mesh, and weight Wc of the sample left on the lower step mesh are measured and the measured values are substituted for the corresponding terms in the equations below to find the coagulation level.

$$A=(Wa/W)\times 100$$

$$B=(Wb/W)\times 100\times(3/5)$$

$$C=(Wc/W)\times 100\times(1/5)$$

$$\text{Coagulation level } (\%)=A+B+C$$

The toner composition according to the invention is unique, wherein the toner composition contains a dye.

The toner composition according to the invention contains a dye and the toner composition can be of many different colors depending on the color of the dye to be included therein.

Furthermore, since the toner composition according to the invention develops a color by means of the dye, it is superior in color development performance and color reproduction to conventional toner compositions that develop colors with pigments.

Typical dyes to be used include a direct dye, acid dye, disperse dye, cationic dye, reactive dye, sulfur dye, oil-soluble dye, and a metallic complex dye. Particularly preferable are the disperse dye and the cationic dye.

Of the disperse dyes, typical black dyes include, for example, Kayalon Polyester Black EX-SF300, Kayalon Polyester Black BR-SF, Kayalon Polyester Black AUL-E, Kayalon Polyester Black AUL-S, and Kayalon Polyester Black ECX 300 manufactured by Nippon Kayaku Co., Ltd.; Resolin Black BSN 200% 01 manufactured by Bayer; Teratop Black RLA and Terasil Black SRL-01 200% manufactured by Ciba Specialty Chemicals; and, Dianix Black RS-E01, Dianix Black S-LF 01, Dianix Black HG-FS conc., Dianix Black TA-N 200% 01, Dianix Black RB-FS 200, Dianix Black RN-SE01, Dianix Black BG-PS 200% 01, Dianix Black SPH extra conc.liquid, Dianix Tuxedo Black F conc.liquid, Dianix Tuxedo Black H conc.liquid 01, Dianix Black K-B, Dianix Black E-G, Dianix Black S-LF 01, Dianix Black TA-N 200% 01, Dianix Black BG-FS 200% 01, and Dianix Black H conc.liquid 01 manufactured by Dyestar.

Typical yellow dyes include, for example, Kayalon Microester Yellow DX-LS, Kayalon Microester Yellow AQ-LE, Kayalon Polyester Light Yellow 5G-S, Kayalon Polyester Yellow 4G-E, Kayalon Polyester Yellow AN-SE, and Kayacelon Yellow E-HGL manufactured by Nippon Kayaku Co., Ltd.; Terasil Yellow 4G, Teratop Yellow NFG and Terasil Yellow GWL-01 150% manufactured by Ciba Specialty Chemicals; and, Dianix Yellow AC-E, Dianix Yellow F3G-E conc., Dianix Yellow 3G-E conc., Dianix Yellow H2G-FS, Dianix Yellow N-TAN, Dianix Yellow G-FS 200, DianixYellow UN-SE200new, Dianix Yellow SE-5G, Dianix Yellow K-4G, Dianix Yellow S-6G, Dianix Yellow AM-42, Dianix Yellow 7GL 200%, Dianix Yellow S-4C, Dianix Brilliant Yellow 5G-E, Dianix Yellow SE-G, Dianix Yellow SPH, Dianix Yellow UN-SE 200% new, Dianix Brilliant Yellow 10G, and Dianix YellowAN-FS liquid manufactured by Dyestar.

Typical magenta dyes include, for example, Kayalon Microester Red DX-LS, Xayalon Microester Red AQ-LE, Kayalon Polyester Red BL-E, Kayalon Polyester Red HL-SF, Kayalon Polyester Red AUL-S, Kayalon Polyester Red 3BL-S 200, Kayalon Polyester Red HBL-SF, Kayacelon Red E-2BL, and Kayalon PolyesterRubine 3GL-S150 manufactured by Nippon Kayaku Co., Ltd.; Teratop Red NFR, Teratop Pink 2GLA and Teratop Pink 3G manufactured by Ciba Specialty Chemicals; and, Dianix Rubine S-2G, Dianix Red SE-3B, Dianix Red BLS 200%, Dianix Red S-LF, Dianix Brilliant Red B-FS, Dianix Red AC-E, Dianix Red BN-SE, Dianix Red A2B-FS, Dianix Carmine UN-SE, Dianix Red CB-SE200, Dianix Red KB-SE, Dianix Red FB-E200, Dianix Red S-G, Dianix Red K-3G, Dianix Red E-FB, Dianix Red UN-SE, Dianix Red N-TAN, Dianix Red F2B 400%, and Dianix Pink FRL-SE 200 manufactured by Dyestar.

Typical cyan dyes include, for example, Kayalon Microester Blue DX-LS, Kayalon Microester Blue AQ-LE, Kayalon Polyester Blue T-S, Kayalon Polyester Turquoise Blue GL-S 200, Kayalon Polyester Light Blue BGL-S 200, Kayacelon Blue E-BG, Kayalon Polyester Blue BR-SF, Xayalon Polyester Blue AUL-S, Kayalon Polyester Blue 4G-S, Kayalon Polyester Brilliant Blue FR-S, and Kayalon Polyester Turquoise Blue GL-S(C)200 manufactured by Nippon Rayaku Co., Ltd.; Teratop Blue BGE, Terasil Blue 3RL-02 150%, Terasil blue BGE-01 200%, Terasil Blue BG-02 200%, and Terasil Blue X-BGE liquid manufactured by Ciba Specialty Chemicals; and, Dianix Turquoise Blue B-FS 200, Dianix Turquoise Blue G-FS 200, Dianix Turquoise Blue G-FS, Dianix Blue K-2G, Dianix Blue HF-2G, DianixBlue BBLSN 200%, Dianix Blue S-BB, Dianix Blue FBL 150%, Dianix Turquoise BN-FS 200%, Dianix Turquoise Blue B-FS 200, Dianix Blue K-2G, Dianix Blue S-BB, Dianix Blue K-FBL, Dianix Blue HF-2G, Dianix Blue S-2G, DianixBlue FR, Dianix Blue AC-E, Dianix Blue 3RLS, Dianix Blue FBL-E, DianixBlue GRN-E 200 01, Dianix Blue FBL 150%, Dianix Blue SPH, Dianix Blue N-TAN, Dianix Blue UN-SE, Dianix Blue S-BG, Dianix Blue KBN-FS, Dianix Blue KRN-FS, Dianix Blue BBLSN 200%, Dianix Turquoise S-BG, and Dianix Royal Blue SE-R manufactured by Dyestar.

To give an example of a method of manufacturing a toner composition containing a dye, as disclosed in Japanese Patent Application Laid-Open Publication No. HEI 10-326029, the dye and resin particles are dispersed in an aqueous solvent and the solvent is agitated, while being heated to a temperature that can range between a softening temperature of the resin particles and a temperature 40° C. higher than the softening temperature. After the resin particles are colored with the dye, they are subjected to reduction cleaning in order to remove excess dye that deposits on the surface of the resin particles. For a solvent used in this reduction cleaning, an aqueous solvent in which sodium hydroxide or hydroxy sulfite is dissolved is to be used.

The toner composition according to the invention has a high fluidity for its spherical shape and a low void ratio for its high bulk density, which makes it superior in that it has a small heat loss during fusing.

The shape of the toner composition according to the invention may be represented by, for example, a sphericity (circularity) ranging between 1 and 0.95.

The sphericity (circularity) as the term used in this specification is one that, for example, is calculated through the following formula and the value is 1 if the shape is a true sphere. For measurement of sphericity, a flow type particle image analyzer FPIA-1000 manufactured by Sysmex may, for example, be used.

$$\text{Sphericity (circularity)} = L1/L2$$

Where,

L1: circumference of a circle having the same projection plane area as the particle image L2: Length of outline of the particle projected image The toner composition according to the invention is used as dry toner for electrostatic latent image developing.

Since it is less likely that a fog or blur occurs when the toner composition according to the invention is used, the toner composition according to the invention is right for dry toner for electrostatic latent image developing.

Furthermore, since the average particle diameter by volume of the toner composition according to the invention is 7 $\mu$m or less, the toner composition according to the intention permits printing of high resolution.

An organic finely divided powder and a charge controlling agent may be added to the toner composition according to the invention in order to make it easy to charge. As a method of applying such a substance, the resin particles, and the organic finely divided powder and charge controlling agent are mixed together by means of a mechanical impact force, thereby injecting the organic finely divided powder and charge controlling agent into the surface of the resin particles, as disclosed, for example, in Japanese Patent Application Laid-Open Publication No. HEI 11-65164.

Typical organic finely divided powders added to achieve the foregoing purpose include an acrylic resin finely divided powder, a fluorinated resin finely divided powder, a silicone resin finely divided powder, and a melamine resin finely divided powder.

Typical charge controlling agents include a metallic azo compound, a salicylic metal complex, a nigrosine, a triphenylmethane, and grade 4 ammonium salt.

The toner composition according to the invention is characterized by that the particle comprising the binder resin is manufactured using a dispersion polymerization method.

The toner composition according to the invention is characterized by that the binder resin particle as a component of the toner composition is manufactured using the dispersion polymerization method.

Since the binder resin particle made using the dispersion polymerization method has a small average particle diameter and a narrow particle diameter distribution, the toner composition according to the invention can have a small particle diameter and a narrow particle diameter distribution.

Use of the toner composition according to the invention, therefore, makes possible printing of high resolution.

Moreover, since the toner composition according to the invention is manufactured using the dispersion polymerization method, it is easy to shape it into a sphere.

The dispersion polymerization method refers, for example, to the following. Namely, a monomer, a dispersing agent, initiator, and the like are loaded in a solvent and, when the solvent is set into a predetermined condition (e.g., a predetermined temperature), the initiator is made into a radical by which the monomer is polymerized to produce polymerized particles. At this time, a spot at which polymerization takes place is uniformly distributed throughout the solvent and a polymerization rate is constant regardless of the spot of polymerization thanks to an effect of the dispersing agent, which ensures that a large number of spherical polymerized particles of a uniform size are produced.

The above and further objects and novel features of the invention will more fully appear from following detailed description when the same is read in connection with the accompanying drawings. It is to be expressly understood, however, that the drawings are for the purpose of illustration only and not intended as a definition of the limits of the invention.

DETAILED DESCRIPTION OF THE EMBODIMENTS

Figure 1:
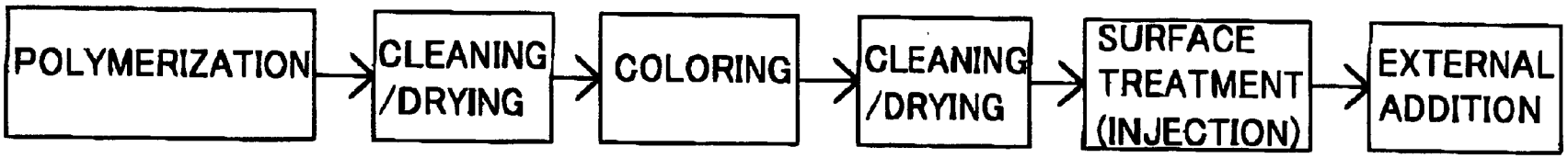
FIG. 1 is an explanatory drawing showing manufacturing processes of the toner composition.

Preferred examples of the toner composition according to the invention will be explained in details.

a) Manufacturing methods of toner compositions for examples 1 through 2 and comparative examples 1 through 8 will be explained. Manufacture of a toner composition follows the steps of polymerization, cleaning and drying, coloring, cleaning and drying, surface treatment (injection), and external addition as shown in FIG. 1.

Part of the polymerized resin particles obtained in the polymerization process is used for measurement of the average particle diameter by volume to be described later.

EXAMPLE 1

A toner composition A was manufactured by following steps <1> through <4> in the following:

<1> Manufacture of Polymerized Resin Particles A (Polymerization and Cleaning/Drying)

Polymerized resin particles A were manufactured using the dispersion polymerization method. More specifically, the following methods were used.

Methanol and isopropyl alcohol as solvents, polyvinyl pyrrolidone K-25 as a dispersing agent, styrene and n-butyl acrylate as monomers, and 2,2'-azobisisobutyronitrile as an initiator were loaded in a reaction apparatus fitted with an agitator, a cooling tube, a thermometer, and a gas inlet tube, while purging nitrogen gas through the gas inlet tube and, the reaction solution was heated to 60° C. and agitated at 100 rpm to carry out polymerization for 14 hours. Table 1 lists the part by weight of each of the compositions at loading.

The solution was thereafter cooled to stop polymerization reaction. Polymerized resin particles obtained were recovered through filtering and cleaned using a water-methanol mixture. They were then left to stand to dry for 48 hours under room temperature to obtain polymerized resin particles A.

<2> Coloring and Cleaning/Drying

Hundred parts by weight of ion-exchange water, 100 parts by weight of polymerized resin particles A manufactured in step <1>, and 20 parts by weight of Kayalon Polyester Red HL-SF (manufactured by Nippon Kayaku Co., Ltd.) as a dye were loaded in the apparatus fitted with the agitator, the cooling tube, and the thermometer. The mixture was heated to 95° C. and agitated at 150 rpm for 1 hour. Colored particles were then recovered through filtering and, to remove excess dyes left on the surface of the colored particles, a reduction cleaning was carried out using a mixture of 100 parts by weight of ion-exchange water, 0.8 parts by weight of sodium hydrosulfite, and 0.8 parts by weight of sodium hydroxide. The colored particles were then left to stand to dry under room temperature for 48 hours to eventually obtain particles A colored in magenta.

<3> Treatment

Using a hybridization system model NSH-O built by Nara Machinery Co., Ltd., 0.3 parts by weight of organic finely divided powder N-70 (manufactured by Nippon Paint Co., Ltd.) and 1 part by weight of a charge controlling agent Bontron E-84 (manufactured by Hodogaya Chemical) were treated into 100 parts by weight of particles A colored in magenta obtained in step <2> under conditions of a rotating speed of 13,000 rpm and a processing time of 5 minutes.

As a result, an treated sample A, which was the particles A colored in magenta, the surface of which was coated with the organic finely divided powder and the charge controlling agent, was obtained.

<4> External Addition

Using Mechanomill manufactured by Okada Seiko Co., Ltd., 1 part by weight of hydrophobic silica H2000 (manufactured by Wacker Co., Ltd.; a BET area/weight ratio of 165.2 $m^2/g$) and 1 part by weight of conductive titanium oxide EC-300 (manufactured by Titan Kogyo Kabushiki Kaisha; a resistance value of 10 to 50 Ω·cm and a BET area/weight ratio of 51.4 $m^2/g$) were externally added to 100 parts by weight of the treated sample A obtained in step <3> under conditions of a rotating speed of 2,750 rpm and a processing time of 3 minutes to eventually obtain the toner composition A.

EXAMPLE 2

A toner composition B was manufactured by following steps <1> through <4> in the following:

<1> Manufacture of Polymerized Resin Particles B (Polymerization and Cleaning/Drying)

Polymerized resin particles B were manufactured using the same method as that used in step <1> of Example 1, except that 77 parts by weight of styrene and 23 parts by weight of n-butyl acrylate were used. Table 1 lists the part by weight of each of the compositions at loading.

<2> Coloring and Cleaning/Drying

Particles B colored in magenta were obtained by following the same processes of coloring, cleaning, and drying as in step <2> of Example 1.

<3> Treatment

An treated sample B was obtained through the same treatment process as in step <3> of Example 1.

<4> External Addition

The toner composition B was obtained through the same external addition process as in step <4>of Example 1.

COMPARATIVE EXAMPLE 1

A toner composition C was manufactured by following steps <1> through <4> in the following:

<1> Manufacture of Polymerized Resin Particles C (Polymerization and Cleaning/Drying)

Polymerized resin particles C were manufactured using the same method as that used in step <1> of Example 1, except that 75 parts by weight of styrene and 25 parts by weight of n-butyl acrylate were used. Table 1 lists the part by weight of each of the compositions at loading.

<2> Coloring and Cleaning/Drying

Except that 10 parts by weight of Kayalon Polyester Black ECX 300 (manufactured by Nippon Kayaku Co., Ltd.) was used as the dye, particles C colored in black were obtained by following the same processes of coloring, cleaning, and drying as in step <2>of Example 1.

<3> Treatment

An treated sample C was obtained through the same treatment process as in step <3> of Example 1.

<4> External Addition

The toner composition C was obtained through the same external addition process as in step <4> of Example 1.

COMPARATIVE EXAMPLE 2

A toner composition D was manufactured by following steps <1> through <4> in the following;

<1> Manufacture of Polymerized Resin Particles D (Polymerization and Cleaning/Drying)

Polymerized resin particles D were manufactured using the same materials and method as those used in step <1> of Example 1. Table 1 lists the part by weight of each of the compositions at loading.

<2> Coloring and Cleaning/Drying

Particles D colored in magenta were obtained by following the same processes of coloring, cleaning, and drying as in step <2> of Example 1.

<3> Treatment

An treated sample D was obtained through the same treatment process as in step <3> of Example 1.

<4> External Addition

Under the same conditions of the setup as in step <4> of Example 1, only 1 part by weight of hydrophobic silica H2000 (manufactured by Wacker Co., Ltd.; a BET area/weight ratio of 165.2 $m^2/g$) was externally added to 100 parts by weight of the treated sample D obtained in step <3> to obtain a toner composition D.

COMPARATIVE EXAMPLE 3

A toner composition E was manufactured by following steps <1> through <4> in the following:

<1> Manufacture of Polymerized Resin Particles E (Polymerization and Cleaning/Drying)

Polymerized resin particles E were manufactured using the same materials and method as those used in step <1> of Example 1. Table 1 lists the part by weight of each of the compositions at loading.

<2> Coloring and Cleaning/Drying

Particles E colored in magenta were obtained by following the same processes of coloring, cleaning, and drying as in step <2> of Example 1.

<3> Treatment

An treated sample E was obtained through the same treatment process as in step <3> of Example 1.

<4> External Addition

Under the same conditions of the setup as in step <4> of Example 1, 0.3 parts by weight of hydrophobic silica H2000 (manufactured by Wacker Co., Ltd.; a BET area/weight ratio of 165.2 $m^2/g$) and 0.3 parts by weight of conductive titanium oxide EC-300 (manufactured by Titan Kogyo Kabushiki Kaisha; a resistance value of 10 to 50 Ω·cm and a BET area/weight ratio of 51.4 $m^2/g$) were externally added to 100 parts by weight of the treated sample E obtained in step <3> to obtain a toner composition E.

COMPARATIVE EXAMPLE 4

A toner composition F was manufactured by following steps <1> through <4> in the following;

<1> Manufacture of Polymerized Resin Particles F (Polymerization and Cleaning/Drying)

Polymerized resin particles F were manufactured using the same materials and method as those used in step <1> of Example 1. Table 1 lists the part by weight of each of the compositions at loading.

<2> Coloring and Cleaning/Drying

Except that 10 parts by weight of Kayalon Polyester Black ECX 300 (manufactured by Nippon Kayaku Co., Ltd.) were used, particles F colored in magenta were obtained by following the same processes of coloring, cleaning, and drying as in step <2> of Example 1.

<3> Treatment

An treated sample F was obtained through the same treatment process as in step <3> of Example 1.

<4> External Addition

Under the same conditions of the setup as in step <4> of Example 1, 2.0 parts by weight of hydrophobic silica H2000 (manufactured by Wacker Co., Ltd.; a BET area/weight ratio of 165.2 $m^2/g$) and 1.5 parts by weight of conductive titanium oxide EC-300 (manufactured by Titan Kogyo Kabushiki Kaisha; a resistance value of 10 to 50 Ω·cm and a BET area/weight ratio of 51.4 $m^2/g$) were externally added to 100 parts by weight of the treated sample P obtained in step <3> to obtain a toner composition F.

COMPARATIVE EXAMPLE 5

A toner composition G was manufactured by following steps <1> through <4> in the following:

<1> Manufacture of Polymerized Resin Particles G (Polymerization and Cleaning/Drying)

Except that 204 parts by weight of methanol, 87 parts by weight of isopropyl alcohol, 77 parts by weight of styrene, and 23 parts by weight of n-butyl acrylate were used, polymerized resin particles G were manufactured using the same method as that used in step <1> of Example 1. Table 1 lists the part by weight of each of the compositions at loading.

<2> Coloring and Cleaning/Drying

Except that 10 parts by weight of Kayalon Polyester Black ECX 300 (manufactured by Nippon Kayaku Co., Ltd.) were used, particles C colored in black were obtained by following the same processes of coloring, cleaning, and drying as in step <2> of Example 1.

<3> Treatment

An treated sample G was obtained through the same treatment process as in step <3> of Example 1.

<4> External Addition

Under the same conditions of the setup as in step <4> of Example 1, only 1 part by weight of hydrophobic silica H2000 (manufactured by Wacker Co., Ltd.; a BET area/weight ratio of 165.2 $m^2/g$) was externally added to 100 parts by weight of the treated sample G obtained in step <3> to obtain a toner composition G.

COMPARATIVE EXAMPLE 6

A toner composition H was manufactured by following steps <1> through <4> in the following:

<1> Manufacture of Polymerized Resin Particles H (Polymerization and Cleaning/Drying)

Except that 233 parts by weight of methanol, 58 parts by weight of isopropyl alcohol, 77 parts by weight of styrene, and 23 parts by weight of n-butyl acrylate were used, polymerized resin particles H were manufactured using the same method as that used in step <1> of Example 1. Table 1 lists the part by weight of each of the compositions at loading.

<2> Coloring and Cleaning/Drying

Except that 10 parts by weight of Kayalon Polyester Black ECX 300 (manufactured by Nippon Kayaku Co., Ltd.) were used, particles H colored in black were obtained by following the same processes of coloring, cleaning, and drying as in step <2> of Example 1.

<3> Treatment

An treated sample H was obtained through the same treatment process as in step <3> of Example 1.

<4> External Addition

The toner composition H was obtained through the same external addition process as in step <4> of Example 1.

COMPARATIVE EXAMPLE 7

A toner composition I was manufactured by following steps <1> through <4> in the following:

<1> Manufacture of Polymerized Resin Particles I (Polymerization and Cleaning/Drying)

Polymerized resin particles I were manufactured using the same materials and method as those used in step <1> of Example 1. Table 1 lists the part by weight of each of the compositions at loading.

<2> Coloring and Cleaning/Drying

Particles I colored in magenta I were obtained by following the same processes of coloring, cleaning, and drying as in step <2> of Example 1.

<3> Treatment

An treated sample I was obtained through the same treatment process as in step <3> of Example 1.

<4> External Addition

Under the same conditions of the setup as in step <4> of Example 1, 1.0 part by weight of hydrophobic silica H2000 (manufactured by Wacker Co., Ltd.; a BET area/weight ratio of 165.2 $m^2/g$) and 1.0 part by weight of insulating titanium oxide STT-30A (manufactured by Titan Kogyo Kabushiki Kaisha; a resistance value of $2\times10^{11}$ Ω·cm and a BET area/weight ratio of 100 $m^2/g$) were externally added to 100 parts by weight of the treated sample I obtained in step <3> to obtain a toner composition I.

COMPARATIVE EXAMPLE 8

A toner composition J was manufactured by following steps <1> through <4> in the following:

<1> Manufacture of Polymerized Resin Particles J (Polymerization and Cleaning/Drying)

Polymerized resin particles J were manufactured using the same materials and method as those used in step <1> of Example 1. Table 1 lists the part by weight of each of the compositions at loading.

<2> Coloring and Cleaning/Drying

Particles J colored in magenta were obtained by following the same processes of coloring, cleaning, and drying as in step <2> of Example 1.

<3> Treatment

An treated sample J was obtained through the same treatment process as in step <3> of Example 1.

<4> External Addition

Under the same conditions of the setup as in step <4> of Example 1, 1.5 parts by weight of hydrophobic silica H2000 (manufactured by Wacker Co., Ltd.; a BET area/weight ratio of 165.2 $m^2/g$) and 1.0 part by weight ot insulating titanium oxide STT-30A (manufactured by Titan Kogyo Kabushiki Kaisha; a resistance value of $2\times10^{11}$ Ω·cm and a BET area/weight ratio of 100 $m^2/g$) were externally added to 100 parts by weight of the treated sample J obtained in step <3> to obtain a toner composition J.

TABLE 1

| Loading Compositions | Example 1 (A)* | Example 2 (B)* | Comparative Example 1 (C)* | Comparative Example 2 (D)* | Comparative Example 3 (E)* |
|---|---|---|---|---|---|
| Methanol | 262 | 262 | 262 | 262 | 262 |
| Isopropyl alcohol | 29 | 29 | 29 | 29 | 29 |
| Polyvinyl pyrrolidone K-25 | 6 | 6 | 6 | 6 | 6 |
| Styrene | 83 | 77 | 75 | 83 | 83 |
| N-butyl acrylate | 17 | 23 | 25 | 17 | 17 |
| 2,2'-azobisisobutyronitrile | 3 | 3 | 3 | 3 | 3 |

*Example 1 and 2 correspond to toner composition A and B respectively, and Comparative Example 1, 2, and 3 correspond to toner composition C, D, and E, respectively.

TABLE 2

| Loading | Comparative Example 4 | Comparative Example 5 | Comparative Example 6 | Comparative Example 7 | Comparative Example 8 |
|---|---|---|---|---|---|
| Compositions | (F)* | (G)* | (H)* | (I)* | (J)* |
| Methanol | 262 | 204 | 233 | 262 | 262 |
| Isopropyl alcohol | 29 | 87 | 58 | 29 | 29 |
| Polyvinyl pyrrolidone K-25 | 6 | 6 | 6 | 6 | 6 |
| Styrene | 83 | 77 | 77 | 83 | 83 |
| N-butyl acrylate | 17 | 23 | 23 | 17 | 17 |
| 2-2'-azobisisobutyronitrile | 3 | 3 | 3 | 3 | 3 |

*Comparative Example 4, 5, 6, 7, and 8 correspond to toner composition F, G, H, I, and J, respectively.

b) The average particle diameters by volume of toner compositions A to J were then measured.

<1> Measurement Method for Average Particle Diameter by Volume

Model Coulter II built by Coulter was used as the measuring machine. As measurement conditions, the diameter of the aperture was adjusted to 50 μm and the concentration of the sample was adjusted to about 50,000 counts per 20 seconds.

<2> Measurement Results

Results of the measurement are shown in Table 3.

TABLE 3

| Polymerized Resin Particle | Average Particle Diameter (μm) |
|---|---|
| A (Example 1) | 4.3 |
| B (Example 2) | 6.9 |
| C (Comparative Example 1) | 7.5 |
| D (Comparative Example 2) | 4.3 |
| E (Comparative Example 3) | 4.3 |
| F (Comparative Example 4) | 4.3 |
| G (Comparative Example 5) | 10.3 |
| H (Comparative Example 6) | 8.4 |
| I (Comparative Example 7) | 4.3 |
| J (Comparative Example 8) | 4.3 |

c) Characteristics of toner compositions of Examples 1 to 2 and Comparative Examples 1 through 8 were then evaluated. Evaluation items were the average particle diameter by volume, coagulation level, external additive coating ratio, changes in fog value during a continuous durability print cycle, a blur after a continuous durability print cycle, and changes in the amount of the toner composition supported by the developing roller during a continuous durability print cycle.

<1> Evaluation Method for the Average Particle Diameter by Volume

Measurements were taken using the same method as that for measuring the average particle diameter by volume of polymerized resin particles in the aforementioned b).

<2> Measurement Method for Coagulation Level

A mesh having a sieve opening of 75 μm, a mesh having a sieve opening of 45 μm, and a mesh having a sieve opening of 20 μm were mounted in the upper step, middle step, and the lower step, respectively, of the powder tester (model PT-E powder tester manufactured by Hosokawa Micron Corporation).

Then, a sample weighing 10 g was placed on the mesh in the upper step and the test setup was vibrated with an amplitude causing the amplitude scale to be 1 mm for 30 sec.

Then, weight Wa of the sample left on the upper step mesh, weight Wb of the sample left on the middle step mesh, and weight Wc of the sample left on the lower step mesh were measured and the measured values were substituted for the corresponding terms in the equations below to find the coagulation level. The unit of weight is g.

$$A=(Wa/10)\times 100$$

$$B=(Wb/10)\times 100\times(3/5)$$

$$C=(Wc/10)\times 100\times(1/5)$$

$$\text{Coagulation level }(\%)=A+B+C$$

<3> Measurement Method for External Additive Coating Ratio

An external additive coating ratio (%) is calculated using the following equation, where S ($m^2/g$) is a BET area/weight ratio of the external additive, R (μm) is an average particle diameter calculated based on particle number, ρ ($g/cm^3$) is a true specific gravity of the toner composition, and P (%) is the amount of external additive applied (the ratio of the weight of the external additive to the entire weight of the toner composition).

The external additive coating ratio is calculated as follows.

$$H=(S\times R\times\rho\times P)/24$$

<4> Measurement Method for a Fog Value During a Continuous Durability Print Cycle The fog value was measured after each of continuous durability print cycles of producing 200, 600, 1,000, and 2,000 printed pages. In addition, the difference between the fog value before and after the durability print cycles was calculated to serve as a fog difference.

The fog value is an index that indicates, in a photoconductor or a sheet of printed paper, the degree with which the toner composition sticks to an area, to which the toner composition should not stick.

For example, in a printer employing an electrostatic latent image developing system, the toner composition can be deposited on a portion on the surface of a photoconductor, on which the toner composition should not be deposited (e.g. a portion that is not charged) because of insufficiently charged toner composition. The fog value refers to the degree with which toner composition is deposited.

The specific measurement method used to measure the fog value is as follows.

Model MICROLINE 600CL page printer manufactured by Oki Data Systems Co., Ltd. was used to produce a solid blank printed page (that is, in a condition in which none of the areas on the surface of the photoconductor is charged and none of the toner composition should be deposited) and Scotch mending tape (manufactured by Sumitomo 3M) was used to sample toner composition sticking to the surface of the photoconductor before image transfer. The tape was then affixed to 4200 DP 201b paper (manufactured by Xerox). For comparison, a piece of fresh tape not used for sampling toner composition was also affixed to the paper.

Model TC-6MC reflection densitometer manufactured by Tokyo Denshoku was used to measure reflection density Ds of the paper, to which tape used for sampling toner composition from the surface of the photoconductor, and reflection density Do of the paper, to which fresh tape not used for sampling toner composition from the surface of the photoconductor, and the fog value was calculated using these reflection density values and the following equation.

$$\text{Fog value}=Do-Ds$$

When reflection density was measured, different filters were used for different colors of toner composition as detailed in the following: namely, filter no. 58 for the magenta toner layer and filter G for the black toner layer.

<5> Method for Evaluating a Blur After a Continuous Durability Print Cycle

A blur was evaluated through visual examination of printed media after the continuous durability print cycle producing 2,000 printed pages.

A blur refers to a portion, to which toner does not stick when it should, on a printed medium.

<6> Measurement Method for the Amount of Toner Composition Supported by the Developing Roller in Continuous Durability Print Cycles The amount of toner composition supported by the developing roller was measured after each of the continuous durability print cycles producing 200, 600, 1,000, and 2,000 printed pages.

More precisely, a collector equipped with a suction pump (filter paper GS25 manufactured by ADVANTEC was used for the trapping filter) was used to collect toner composition supported by the developing roller for a solid blank print cycle after the specified number of printed pages were produced and the weight of toner composition collected was measured using an electronic balance. The amount of toner composition supported was then calculated based on the weight and the area of toner composition trapped.

<7> Measurement Results

For each of the toner compositions of Examples 1 to 2 and Comparative Examples 1 through 8, the average particle diameter by volume, coagulation level, and the external additive coating ratio are shown in Table 4, changes in the fog value during durability printing (fog difference) and an evaluation result are shown in Table 5, and the blur after a continuous durability print cycle is shown in Table 6. The column marked with "-" in Table 5 indicates that no measurements were taken.

Figure 2:
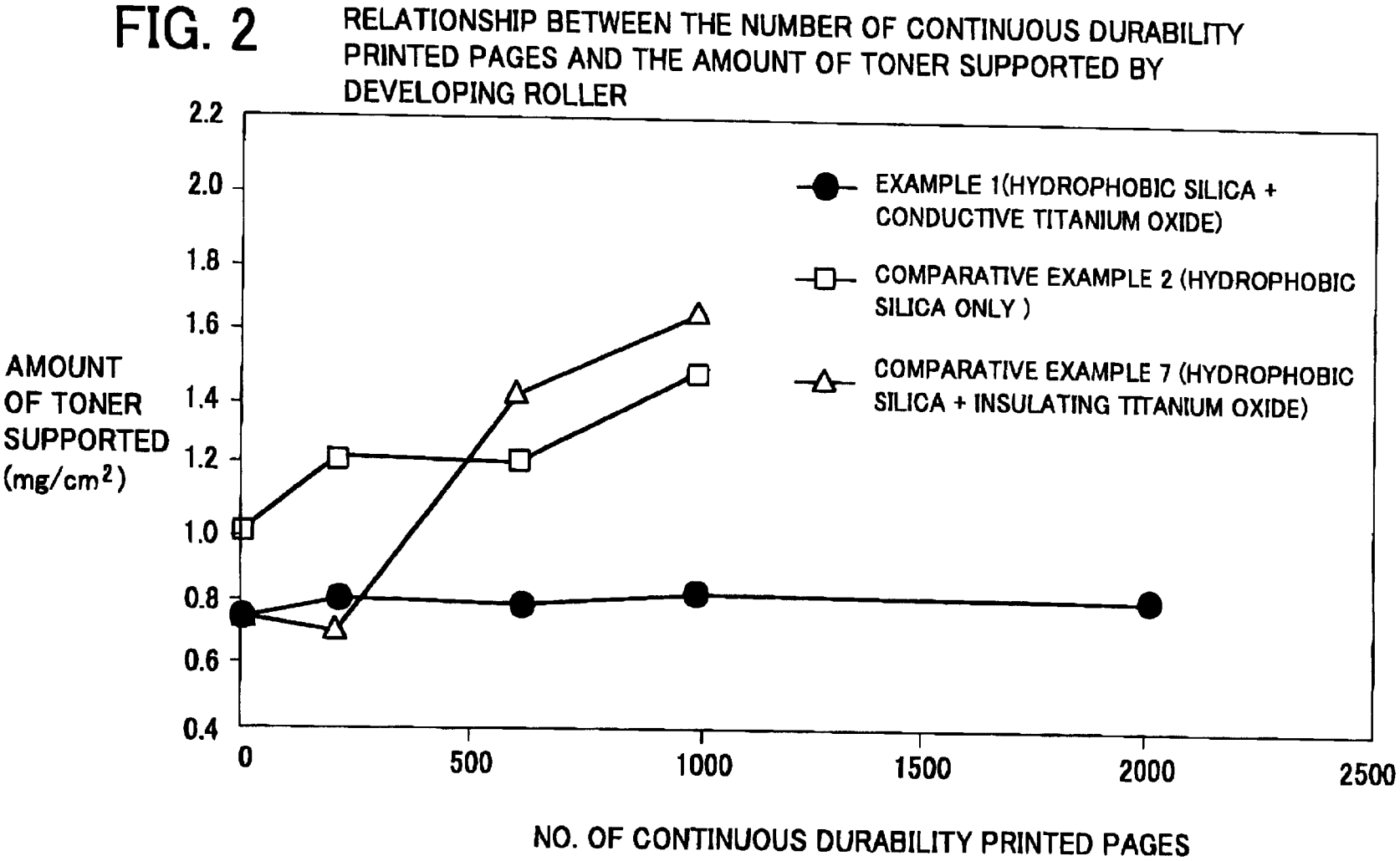
FIG. 2 is an explanatory drawing showing changes in the amount of toner supported by the developing roller in a continuous durability print cycle for the toner compositions according to Examples and Comparative Examples.

FIG. 2 shows the changes in the amount of toner composition supported by the developing roller in continuous durability printing for Example 1, Comparative Example 2, and

TABLE 4

| | Amount of hydrophobic silica externally added (wt %) | Amount of titanium oxide externally added (wt %) | Resistance value of titanium oxide (Ω · cm) | Average particle diameter by volume (μm) | Coagulation level (%) | External additive coating ratio (%) |
|---|---|---|---|---|---|---|
| Example 1 (A)* | 1.0 | 1.0 | 10–50 | 4.4 | 2.4 | 40.7 |
| Example 2 (B)* | 1.0 | 1.0 | 10–50 | 6.9 | 7.8 | 62.5 |
| Comparative Example 1 (C)* | 1.0 | 1.0 | 10–50 | 7.7 | 8.5 | 68.5 |
| Comparative Example 2 (D)* | 1.0 | Not externally added | — | 4.5 | 3.1 | 31.0 |
| Comparative Example 3 (E)* | 0.3 | 0.3 | 10–50 | 4.7 | 13.4 | 12.2 |
| Comparative Example 4 (F)* | 2.0 | 1.5 | 10–50 | 4.5 | 9.5 | 76.6 |
| Comparative Example 5 (G)* | 1.0 | Not externally added | — | 10.5 | 18.8 | 68.9 |
| Comparative Example 6 (H)* | 1.0 | 1.0 | 10–50 | 8.5 | 10.6 | 77.5 |
| Comparative Example 7 (I)* | 1.0 | 1.0 | $2 \times 10^{11}$ | 4.4 | 13.5 | 49.8 |
| Comparative Example 8 (J)* | 1.5 | 1.0 | $2 \times 10^{11}$ | 4.6 | 9.0 | 65.4 |

* Examples 1 and 2 correspond to toner composition A and B respectively, and Comparative Examples 1, 2, 3, 4, 5, 6, 7, and 8 correspond to toner composition C, D, E, F, G H, I, and J, respectively.

TABLE 5

| | Fog value after continuous durability print cycles | | | | | Difference in fog value before durability print cycles and after the print cycle producing 2,000 printed pages | Evaluation |
|---|---|---|---|---|---|---|---|
| | Before durability print cycles | After a print cycle producing 200 printed pages | After a print cycle producing 600 printed pages | After a print cycle producing 1,000 printed pages | After a print cycle producing 2,000 printed pages | | |
| Example 1 (A)* | 1.3 | 1.5 | 1.6 | 0.7 | 1.1 | −0.2 | ○ |
| Example 2 (B)* | 1.2 | 1.2 | 2.3 | 4.2 | 5.3 | 4.1 | ○ |
| Comparative Example 1 (C)* | 2.0 | 2.0 | 5.0 | 13.5 | 23.0 | 21.0 | × |
| Comparative Example 2 (D)* | 1.9 | 3.4 | 34.2 | — | — | 32.3 | × |
| Comparative Example 3 (E)* | 1.0 | 1.8 | 1.6 | — | — | 0.6 | ○ |
| Comparative Example 4 (F)* | 0.5 | 0.5 | 0.9 | 1.3 | 2.7 | 2.2 | ○ |

TABLE 5-continued

| | Fog value after continuous durability print cycles | | | | | Difference in fog value before durability print cycles and after the print cycle producing 2,000 printed pages | Evaluation |
|---|---|---|---|---|---|---|---|
| | Before durability print cycles | After a print cycle producing 200 printed pages | After a print cycle producing 600 printed pages | After a print cycle producing 1,000 printed pages | After a print cycle producing 2,000 printed pages | | |
| Comparative Example 5 (G)* | 1.8 | 3.6 | 8.3 | 29.4 | — | 27.6 | × |
| Comparative Example 6 (H)* | 8.5 | 19.6 | 35.8 | 43.4 | — | 34.9 | × |
| Comparative Example 7 (I)* | 1.7 | 2.7 | 9.3 | 30.1 | — | 28.4 | × |
| Comparative Example 8 (J)* | 1.5 | 2.1 | 8.4 | 25.4 | — | 23.9 | × |

*Examples 1 and 2 correspond to toner composition A and B respectively, and Comparative Examples 1, 2, 3, 4, 5, 6, 7, and 8 correspond to toner composition C, D, E, F, G, H, I, and J, respectively.

TABLE 6

| | Blur after durability print cycles |
|---|---|
| Example 1 (A)* | None (2,000 printed pages) |
| Example 2 (B)* | None (2,000 printed pages) |
| Comparative Example 1 (C)* | None (2,000 printed pages) |
| Comparative Example 2 (D)* | Noted (600 printed pages) |
| Comparative Example 3 (E)* | Noted (600 printed pages) |
| Comparative Example 4 (F)* | Noted (2,000 printed pages) |
| Comparative Example 5 (G)* | None (1,000 printed pages) |
| Comparative Example 6 (H)* | None (1,000 printed pages) |
| Comparative Example 7 (I)* | None (1,000 printed pages) |
| Comparative Example 8 (J)* | None (1,000 printed pages) |

*Examples 1 and 2 correspond to toner composition A and B respectively, and Comparative Examples 1, 2, 3, 4, 5, 6, 7, and 8 correspond to toner composition C, D, E, F, G, H, I, and J, respectively.

Referring to Tables 4 through 6, the toner compositions of Examples 1 and 2 have a fog difference of 4.1 or less and, at the same time, produce no blur after continuous durability print cycles. There is almost no increase in the amount of the toner composition according to Example 1 supported by the developing roller during continuous durability print cycles.

Comparative Example 1 represents a toner composition having an average toner particle by volume of 7.7 $\mu$m, being beyond the scope of the invention. If this toner composition is used, a large fog difference of 21.0 will result.

Comparative Example 2 represents a toner composition, to which conductive titanium oxide is not externally added, being beyond the scope of the invention. If this toner composition is used, a large fog difference of 32.3 will result and a blur occurs after continuous durability print cycles. There is also an increase in the amount of the toner composition supported by the developing roller during continuous durability print cycles.

Comparative Example 3 represents a toner composition having a coagulation level of 13.4%, being beyond the scope of the invention. If this toner composition is used, a blur will occur after continuous durability print cycles.

Comparative Example 4 represents a toner composition having an external additive coating ratio of 76.6%, being beyond the scope of the invention. If this toner composition is used, a blur will occur after continuous durability print cycles.

Comparative Example 5 represents a toner composition containing no conductive titanium oxide, having an average particle diameter by volume of 10.5 $\mu$m, and having a coagulation level of 18.9%, being beyond the scope of the invention. If this toner composition is used, a big fog difference of 27.6 will result and a blur will occur after continuous durability print cycles.

Comparative Example 6 represents a toner composition having an average toner particle by volume of 8.5 $\mu$m, a coagulation level of 10.6%, and an external additive coating ratio of 77.5%, being beyond the scope of the invention. If this toner composition is used, a large fog difference of 34.9 will result.

Comparative Example 7 represents a toner composition containing insulating titanium oxide instead of conductive titanium oxide and having a coagulation level of 13.5%, being beyond the scope of the invention. If this toner composition is used, a large fog difference of 28.4 will result and there will also be an increase in the amount of the toner composition supported by the developing roller during continuous durability print cycles.

Comparative Example 8 represents a toner composition containing insulating titanium oxide instead of conductive titanium oxide, being beyond the scope of the invention. If this toner composition is used, a large fog difference of 23.9 will result.

d) Experiments carried out to determine a distribution of the level of charge of toner compositions and changes in the level of charge of toner compositions during continuous durability print cycles will be explained.

<1> Four different types of toner compositions were used for the experiments; toner compositions K, L, M, and N.

The toner composition K has an average particle diameter by volume of 4.4 microns. The manufacturing method of Example 1 was basically used, but the conductive titanium oxide was not externally added. The toner composition K is therefore beyond the scope of the invention.

The toner composition L has an average particle diameter by volume of 8.5 microns. The manufacturing method of Example 6 was basically used, but the conductive titanium oxide was not externally added. The toner composition L is therefore beyond the scope of the invention.

The toner composition M has an average particle diameter by volume of 4.4 microns, manufactured through the manufacturing method of Example 1. The toner composition M is therefore within the scope of the invention.

The toner composition N has an average particle diameter by volume of 8.5 microns, manufactured through the manufacturing method of Example 6. The toner composition N is therefore beyond the scope of the invention.

Figure 3:
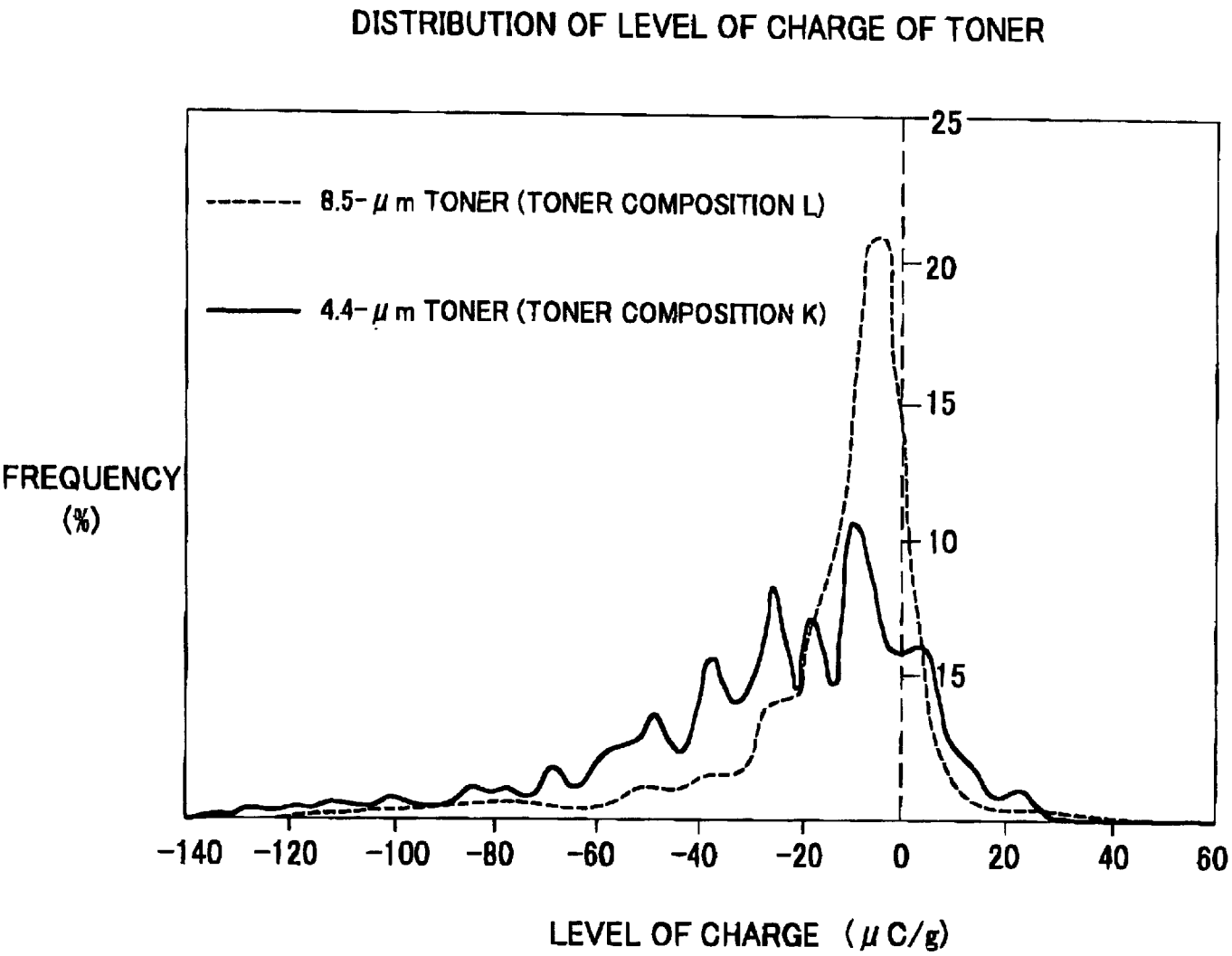
FIG. 3 is an explanatory drawing showing the distribution of the level of charge of the toner composition.

<2> A distribution of the level of charge per unit weight was measured with toner compositions K and L. More specifically, Model MICROLINE 600CL page printer manufactured by Oki Data Systems Co., Ltd. was used to produce 30 solid blank printed pages and E-Spart Analyzer manufactured by Hosokawa Micron Corporation was then used to measure the level of charge and particle diameter of 3,000 toner particles supported by the developing roller. The multivariate analysis was then used to calculate the distribution of the level of charge per unit weight. FIG. 3 shows the results of this calculation. The conditions used for the measuring instruments were as follows.

Measuring Instrument Conditions
EST-II nitrogen pressure: 0.2 to 0.3 kgf/cm$^2$
Suction air flow rate: 400 cc/min
Dust removing air flow rate: 0.26 NL/min
ESF-I roller feed width: 120 mm
Roller feed rate: 0.3 mm/min
Rotating angle: 25°
Pulse duration: 1 sec.
Interval: 4 sec.

Referring to FIG. 3, the toner composition having the smaller average particle diameter by volume, of the toner compositions to which conductive titanium oxide was not externally added, has a greater average value of the level of charge per unit weight and a wider distribution of the level of charge.

<3> A change in the level of charge per unit weight during continuous durability print cycles was measured with the toner compositions M and N. More specifically, a collector (filter paper GC25 manufactured by ADVANTEC was used for the trapping filter), which was equipped with a suction pump and to which a charge level measuring machine (617 PROGRAMMABLE ELECTROMETER manufactured by KEITHLEY) was connected, was used to collect toner composition supported by the developing roller for a solid blank print cycle after the specified number of printed pages were produced. The level of charge and the weight of the toner composition collected were then used to calculate the level of charge per unit weight of the toner composition.

Figure 4:
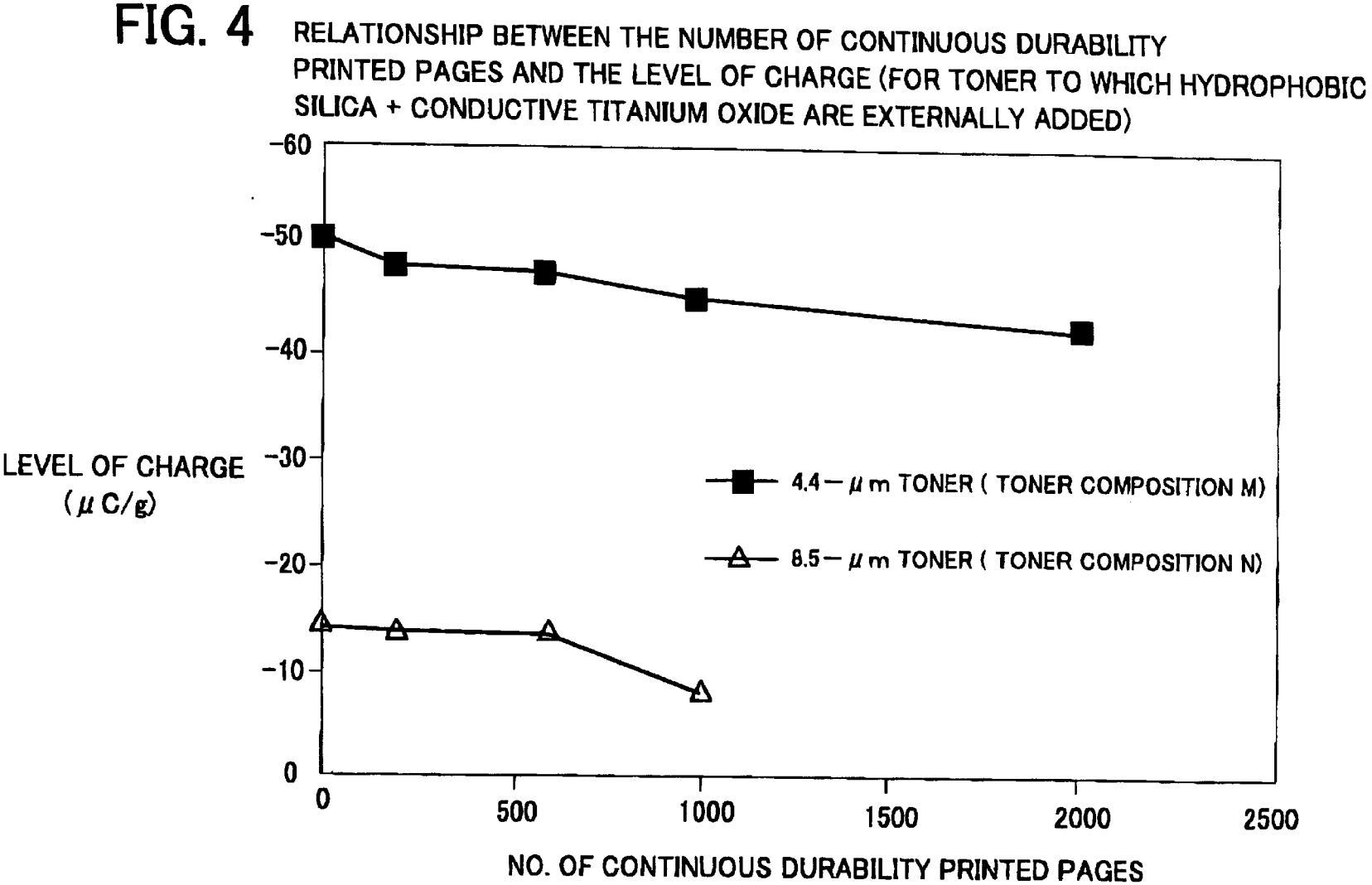
FIG. 4 is an explanatory drawing showing changes in the level of charge of the toner composition in a continuous durability print cycle.
Figure 5:
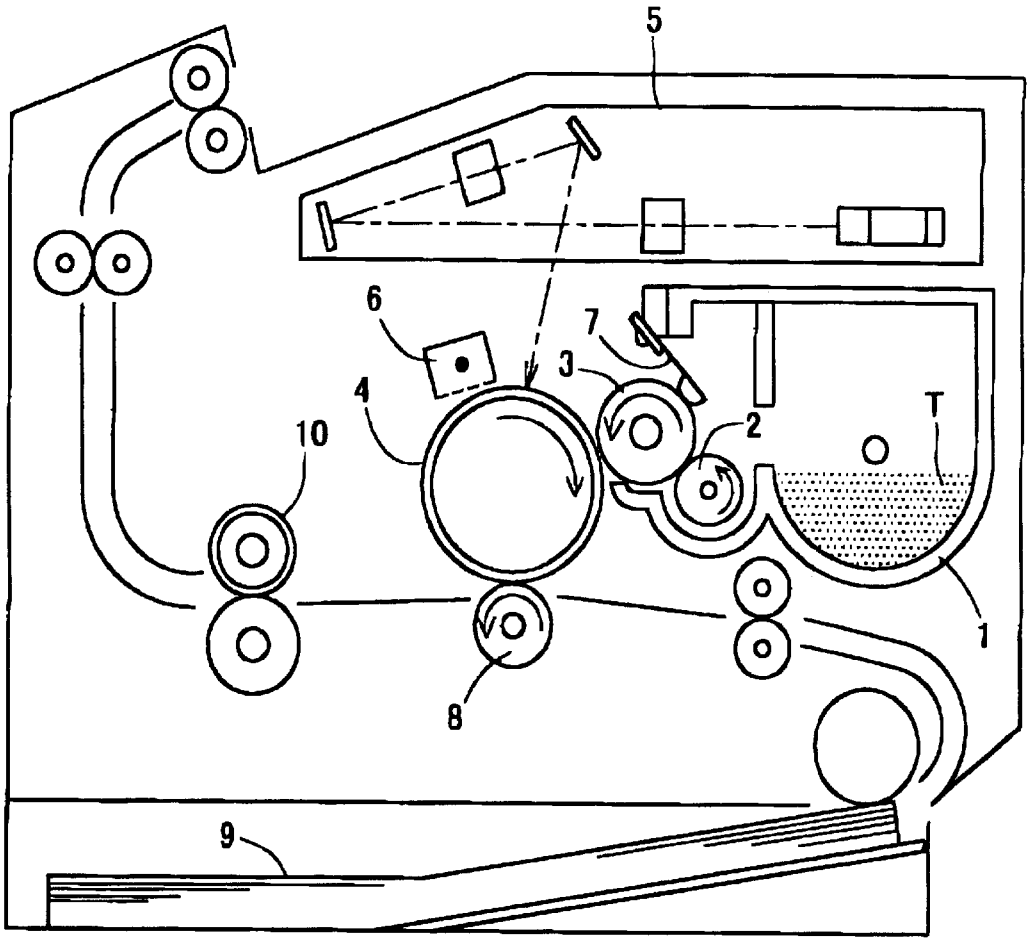
FIG. 5 is an explanatory drawing showing a printer employing an electrostatic latent image developing system.

Referring to FIG. 4, the toner composition (composition M) having an average particle diameter by volume of 4.4 microns has a higher level of charge per unit weight in the beginning. With both the toner compositions M and N, the level of charge per unit weight decreases as more pages are printed.

It is to be understood that the invention is not limited to the aforementioned embodiments, rather, various other embodiments are possible without departing from the spirit and scope of the invention.

The solvent used by the dispersion polymerization method in the manufacture of polymerized resin particles may be a mixture of one or two or more types of alcohol including, for example, methanol, ethanol, n-butanol, s-butanol, tertiary butanol, n-amyl alcohol, s-amyl alcohol, tertiary amyl alcohol, isoamyl alcohol, isobutyl alcohol, isopropyl alcohol, 2-ethylbutanol, 2-ethylhexanol, 2-octanol, n-octanol, n-decanol, cyclohexanol, n-hexanol, 2-heptanol, 3-heptanol, 3-pentanol, methylcyclohexanol, 2-methyl-2-butanol, 3-methyl-2-butanol, 3-methyl-1-butyne-3-ol, 4-methyl-2-pentanol, and 3-methyl-1-pentene-3-ol. Of all these types of alcohol, a combination of methanol and isopropyl alcohol is particularly preferable.

The organic solvents used in combination with these types of alcohol include, for example, hydrocarbon solvents such as hexane, toluene, cyclohexane, benzene, xylene, or the like; ethers such as ethyl benzyl ether, dibutyl ether, dipropyl ether, dibenzyl ether, dimethyl ether, vinyl methyl ether, vinyl ethyl ether, tetrahydrofuran, or the like; ketones such as acetaldehyde, acetone, acetophenone, di-isobutyl ketone, di-isopropyl ketone, cyclohexanone, or the like; esters such as ethyl formate, ethyl acetate, methyl acetate, ethyl stearate, methyl stearate, or the like; and water. These solvents are used to adjust the SP value (solubility parameter) of the reaction system.

The dispersing agent used by the dispersion polymerization method in the manufacture of polymerized resin particles may be a mixture of one or several types of dispersing agents including, for example, polyvinyl pyrrolidone, polyvinyl alcohol, polyethylene-imine, hydroxypropyl cellulose, hydroxypropyl methyl cellulose, hydroxypropyl ethyl cellulose, polyisobutylene, polyacrylic acid, polyacrylic ester, polymethacrylic acid, polyester methacrylate, polyacrylamide, and polyvinyl acrylic ether. of these, polyvinyl pyrrolidone or polyethylene-imine is preferable to manufacture monodisperse polymerized resin particles with a narrow particle distribution.

The monomers used by the dispersion polymerization method in the manufacture of polymerized resin particles include, for example, aromatic vinyls such as styrene, vinyltoluene, α-methylstyrene, vinyl biphenyl, vinylnaphthalene, or the like; methacrylate esters such as methyl methacrylate, ethyl methacrylate, 2-ethylhexyl methacrylate, or the like; acrylic esters such as methyl acrylate, ethyl acrylate, butyl acrylate, ethylhexyl acrylate, or the like; vinyl esters such as acrylonitrile, vinyl formate, vinyl acetate, vinyl propionate, or the like; vinyl ethers such as vinyl methyl ether, vinyl ethyl ether, or the like; methacrylic acid, acrylic acid, maleic anhydride, and metallic salt thereof; amides such as acrylamide, methacrylamide, or the like; monomers having functional groups such as diethylaminoethyl methacrylate, diethylaminoethyl acrylate, or the like; and, monomers containing fluorine such as trifluoroethyl methacrylate, tetrafluoropropyl methacrylate, or the like.

The polymerized resin particles used as binder resin particles of the toner composition has preferably a high transparency considering an application thereof to OHP transparencies. It is also preferable that they have a high insulation performance in order to obtain good developing images. Furthermore, it is preferable that the polymerized resin particles have a high mechanical strength under room temperature so as not to be crushed inside a developing apparatus and, at the same time, soften to be fixed onto a printed medium without requiring large amounts of energy. When these aspects are taken into consideration, an ideal monomer would be a mixture of styrene and acrylic ester, or styrene and methacrylate ester.

The initiators used by the dispersion polymerization method in the manufacture of polymerized resin particles include, for example, as azo base and hydrochloride base, 2,2'-azobis (2-methyl-N-phenyl propionic amidine) dihydro chloride, 2,2'-azobis [N-(4-chlorophenyl)-2-methyl propionic amidine)] dihydro chloride, 2,2'-azobis [N-(4-hydroxyphenyl)-2-methyl propionic amidine)] dihydro chloride, 2,2'-azobis [N-(4-aminophenyl)-2-methylpropionic amidine)] tetrahydro chloride, 2,2'-azobis [2-methyl-N-(phenylmethyl) propionic amidine) dihydro chloride, 2,2'azobis [2-methyl-N-2-propenyl propionic amidine) dihydro chloride, 2,2'-azobis (2-methyl propionic amidine) dihydro chloride, 2,2'-azobis [N-(2-hydroxyethyl)-2-methyl propionic amidine] dihydro chloride, 2,2'-azobis (2-5-methyl-2-imidazoline-2-yl) propane] dihydro chloride, 2,2'-azobis [2-(2-imidazoline-2-yl) propane] dihydro chloride, 2,2'-azobis [2-(4,5,6,7-tetrahydro-1H-1,3-diazepyn-2-yl) propane] dihydro chloride, 2,2'-azobis (2-(3,4,5,6-tetrahydro pyridine-2-yl) propane] dihydro chloride, 2,2'-azobis [2-(5-hydroxy-3,4,5,6-tetrahydro pyridine-2-yl) propane] dihydro chloride, and 2,2'-azobis (2-[1-(2-hydroxy ethyl)-2-imidazoline-2-yl) propane] dihydro chloride.

Other azo-base initiators include 2,2'-azobisisobutyronitrile, 2,2'-azobismethylbutyronitrile, 2,2'-azobis-2-cyclopropyl propionitrile, 2,2'-azobis-4-methoxy-2,4-dimethyl valeronitrile, 1,1'-azobis cyclohexane-1-carbonitrile, 2,2'-azobis (2,4-dimethyl) valeronitrile, 2-phenylazo-4-methoxy-2,4-dimethyl valeronitrile, and 2,2'-azobis-N,N'-dimethylene isobutyl amidine.

Organic peroxide initiators include benzoyl peroxide, methyl ethyl ketone peroxide, cumene hydroperoxide, tertiary butyl hydroperoxide, cyclohexanone hydroperoxide, tertiary butyl peroxide, tertiary butyl peroxy benzoate, tertiary butyl peroxy-2-ethylhexanoate, tertiary butyl peroxy pivalate, t-butyl peroxy neo-decanoate, 3,5,5-trimethyl hexanol peroxide, di-isopropyl benzene hydroperoxide, lauroyl peroxide, and dicumyl peroxide.

Any one of these initiators or a mixture of a plurality thereof is used. Particularly preferable among other initiators are 2,2'-azobisisobutyronitrile and benzoyl peroxide.

The crosslinking agents used by the dispersion polymerizationmethod in themanufacture of polymerized resin particles include, for example, divinylbenzene, divinyl biphenyl, divinyl naphthalene, ethylene glycol di-acrylate, ethylene glycol di-methacrylate, butanediol di-acrylate, butanediol di-methacrylate, trimethylolpropane tri-acrylate, trimethylolpropane tri-methacrylate, pentaerythritol tri-acrylate, and pentaerythritol tri-methacrylate.

Considering that a mixture of styrene and acrylic ester, or a mixture of styrene and methacrylate ester, is used as the monomer when polymerizing resin particles, it is particularly preferable that divinylbenzene, divinyl biphenyl, ethylene glycol di-acrylate, and ethylene glycol di-methacrylate be used as the crosslinking agent among others.

Cleaning of polymerized resin particles recovered in the manufacture of polymerized resin particles can be accomplished by dispersing the polymerized resin particles in a solvent of alcohol or water and then filtering them. Repeating this cleaning procedure one to five times will allow polymerized resin particles with no impurities left to be obtained.

What is claimed is:

1. A toner composition having a shape of a particle and containing a binder resin and a colorant, wherein:

a surface of the toner composition is coated with an external additive comprising a hydrophobic silica and a conductive titanium oxide; and, the particle making up the toner composition has an average particle diameter by volume of 7 $\mu$m or less, an external additive coating ratio of 5–70%, and a coagulation level indicating the degree with which each of toner particles making up the toner composition is coagulated each other in a dry state of 1–10%.

2. The toner composition according to claim 1, wherein the average particle diameter by volume lies in a range between 1 $\mu$m and 7 $\mu$m.

3. The toner composition according to claim 1, wherein the external additive coating ratio lies in a range between 5% and 70%.

4. The toner composition according to claim 1, wherein the coagulation level lies in a range between 1% and 10%.

5. The toner composition according to claim 1 wherein the colorant is a dye.

6. The toner composition according to claim 1 wherein the shape of the toner composition is spherical.

7. The toner composition according to claim 6, wherein a sphericity of the toner composition lies in a range between 0.95 and 1.

8. The toner composition according to claim 1, wherein the toner composition is used as dry toner for electrostatic latent image development.

9. The toner composition according to claim 1, wherein a dispersion polymerization method is used to manufacture particles comprising the binder resin.

* * * * *